US009832576B2

(12) United States Patent
Jensen et al.

(10) Patent No.: US 9,832,576 B2
(45) Date of Patent: Nov. 28, 2017

(54) PARTNER MICROPHONE UNIT AND A HEARING SYSTEM COMPRISING A PARTNER MICROPHONE UNIT

(71) Applicant: OTICON A/S, Smørum (DK)

(72) Inventors: Jesper Jensen, Smørum (DK); Michael Syskind Pedersen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/042,944

(22) Filed: Feb. 12, 2016

(65) Prior Publication Data

US 2016/0241975 A1 Aug. 18, 2016

(30) Foreign Application Priority Data

Feb. 13, 2015 (EP) ..... 15154949

(51) Int. Cl.
*H04R 25/00* (2006.01)
*H04R 3/00* (2006.01)

(52) U.S. Cl.
CPC ..... *H04R 25/554* (2013.01); *H04R 3/005* (2013.01); *H04R 25/405* (2013.01); (Continued)

(58) Field of Classification Search
CPC .... H04R 3/005; H04R 25/405; H04R 25/407; H04R 25/554; H04R 2201/40; (Continued)

(56) References Cited

U.S. PATENT DOCUMENTS 7,738,666 B2 * 6/2010 Marquis ..... H04R 25/30 381/315
2014/0056435 A1 * 2/2014 Kjems ..... H04M 9/082 381/317
2016/0073203 A1 * 3/2016 Kuriger ..... H04R 25/43 381/23.1

FOREIGN PATENT DOCUMENTS

EP 1 863 320 A1 12/2007
EP 2 701 145 A1 2/2014
(Continued)

OTHER PUBLICATIONS

Kjems et al., "Maximum Likelihood Based Noise Covariance Matrix Estimation for Multi-Microphone Speech Enhancement," 20th European Signal Processing Conference (EUSIPCO 2012), Bucharest, Romania, Aug. 27-31, 2012, pp. 295-299.

*Primary Examiner* — Brian Ensey
(74) *Attorney, Agent, or Firm* — Birch, Stewart, Kolasch & Birch, LLP

(57) ABSTRACT

A partner microphone unit comprising a) a multitude microphones for picking up a sound from the environment providing corresponding electric input signals, each comprising a target signal component and a noise signal component; b) a multi-input unit noise reduction system for providing an estimate Ŝ of the target sound s comprising the person's voice and comprising a multi-input beamformer filtering unit coupled to said input units and configured to determine filter weights for providing a beamformed signal, wherein signal components from other directions than a direction of the target signal source are attenuated, whereas signal components from the direction of the target signal source are left un-attenuated; c) antenna and transceiver circuitry for establishing an audio link to another device; and wherein the multi-input beamformer filtering unit comprises an adaptive beamformer is provided.

22 Claims, 5 Drawing Sheets

(52) U.S. Cl.
CPC ..... *H04R 25/407* (2013.01); *H04R 2201/40* (2013.01); *H04R 2225/43* (2013.01); *H04R 2225/51* (2013.01); *H04R 2225/55* (2013.01); *H04R 2420/07* (2013.01); *H04R 2430/23* (2013.01)

(58) Field of Classification Search
CPC ..... H04R 2225/43; H04R 2225/51; H04R 2225/55; H04R 2420/07; H04R 2430/23
See application file for complete search history.

(56) References Cited

FOREIGN PATENT DOCUMENTS

| | | | |
|---|---|---|---|
| EP | 2 835 986 | A1 | 2/2015 |
| WO | WO 2014/055312 | A1 | 4/2014 |

* cited by examiner

PARTNER MICROPHONE UNIT AND A HEARING SYSTEM COMPRISING A PARTNER MICROPHONE UNIT

SUMMARY

The present application relates to a partner microphone unit comprising a wireless transmitter and to hearing system for augmenting a target sound source (picked up by the partner microphone unit). The disclosure relates specifically to a partner microphone unit configured to pick up target sound from a target sound source, the target sound s comprising a voice of a person.

The application furthermore relates to a hearing system comprising a partner microphone unit and a hearing device.

Embodiments of the disclosure may e.g. be useful in applications such as hearing aids, headsets, ear phones, active ear protection systems. Embodiments of the disclosure may further be useful in applications such as teleconferencing systems, public address systems, karaoke systems, classroom amplification systems, etc.

Today, partner microphones typically consist of a single microphone with wireless transmission capabilities. The partner microphone is attached to a target person of interest, the microphone picks of the voice signal of this person and wirelessly transmits it to one or more hearing devices of a user. Placing in this way a wireless microphone close to a sound source of interest makes communication in challenging environments easier. The term 'partner microphone' is to be understood in relation to a user wearing a hearing device, e.g. a hearing aid, and for whom the person wearing the 'partner microphone' is seen as a communication partner. The term 'partner microphone' is in the present context taken to mean a microphone that is attached to a person that act as a communication partner for a person wearing a hearing device. Apart from this use-related indication, the term 'partner' is not no is intended to indicate any particular technical meaning or limitation of the 'partner microphone unit' (the term 'partner' may thus be omitted without any intended change in the meaning).

In the present disclosure, we propose a partner microphone system consisting of a) two or more microphones, b) signal processing capabilities, and c) wireless transmission capabilities. The purpose of this improved partner microphone system is identical to today: to pick up and wirelessly transmit a target signal to a user of a hearing device, e.g. a hearing aid.

Even though the microphones of the partner microphone system are placed relatively close to the sound source of interest (the mouth of the partner-mic. wearer), the target-signal-to-noise ratio of the signal picked up by the microphones may still be less than desired, for example in a car or plane cabin situation. For that reason, a beamformer—noise reduction system may be employed in the partner-microphone system to retrieve the target voice signal from the noise background and in this way increase the SNR, before the target voice signal is wirelessly transmitted to the user of the hearing device. Any spatial noise reduction system works best if the position of the target source relative to the microphones is known. In hearing aid systems, this is less of a problem because the target signal is (assumed to be) located in the frontal direction, i.e., in the direction of the microphone axis (between two closely spaced microphones) of a behind-the-ear hearing aid. In the current situation, however, the microphone axis of the partner-microphone system may not be fixed: Firstly, the partner-microphone system may be attached casually so that it does not "point" directly to the wearer's mouth, and secondly, the partner-microphone system is attached to a variable surface (e.g. clothes) on the chest of the wearer, so that the position/direction of the clip relative to the wearer's mouth may change over time. A consequence of this is that the beamformer-noise reduction system works less good, and in worst case the SNR is decreased rather than increased.

The (two or more) microphones of the partner-mic. system are used to pick up the partner microphone wearers' voice, process the (potentially noisy microphone signals) to retrieve the underlying voice signal, and transmit the retrieved voice signal wirelessly to the hearing aid user. Specifically, in the wireless partner microphone system we construct a dedicated beamformer-noise reduction system, to retrieve the target voice signal. The technical solution of this task is generally difficult, but in this particular situation it is made slightly easier by the fact that partner microphone is located relatively close to the user's mouth so that the practical SNRs are going to be relatively high in the first place; this makes it relative easy to detect at the partner microphone system, when the wearer is speaking and when he or she is quiet; this latter point allows the proposed noise reduction system to estimate the (generally time-varying) noise power spectral density of the disturbing background noise (when the wearer is silent).

An object of the present application is provide an improved quality of a target signal.

Objects of the application are achieved by the invention described in the accompanying claims and as described in the following.

A Partner Microphone Unit:

In an aspect of the present application, an object of the application is achieved by a partner microphone unit configured to pick up target sound from a target sound source, the target sound s comprising a voice of a person, the partner microphone unit comprising

- a multitude of input units IUi, i=1, 2, . . . , M, M being larger than or equal to two, each input unit comprising a microphone for picking up a sound from the environment of the partner microphone unit and configured to provide corresponding electric input signals, each electric input signal comprising a target signal component and a noise signal component;
- a multi-input unit noise reduction system for providing an estimate $\hat{S}$ of the target sound s comprising the person's voice, the multi-input unit noise reduction system comprising a multi-input beamformer filtering unit operationally coupled to said multitude of input units IUi, i=1, . . . , M, and configured to determine filter weights for providing a beamformed signal, wherein signal components from other directions than a direction of the target signal source are attenuated, whereas signal components from the direction of the target signal source are left un-attenuated or are attenuated less relative to signal components from said other directions;
- antenna and transceiver circuitry for establishing an audio link to another device, wherein the multi-input beamformer filtering unit comprises a fixed or adaptive beamformer.

In an embodiment, the fixed beamformer is determined in an off-line procedure prior to normal use of the partner microphone, where the partner microphone is mounted on a dummy model or on the intended user in a realistic position and orientation relative to the mouth of the dummy model or person.

In an embodiment, the multi-input beamformer filtering unit comprises a fixed and an adaptive beamformer.

In an embodiment, the multi-input beamformer filtering unit comprises an MVDR beamformer.

In an embodiment, the multi-input beamformer filtering unit is adaptive.

In an embodiment, the multi-input unit noise reduction system is a multi-microphone noise reduction system.

In an embodiment, 'another device' comprises a hearing device, e.g. a hearing aid.

In an embodiment, 'another device' in the meaning 'the other device' previously referred to and to which the microphone unit is adapted to transmit the estimate $\hat{S}$ of the target sound comprises a hearing device, e.g. a hearing aid. In an embodiment, the other device comprises an (intermediate) auxiliary device between the partner microphone unit and a hearing device, e.g. an audio gateway or a remote control or a communication device (e.g. a SmartPhone).

In an embodiment, the multi-input noise reduction system is configured to be adaptive.

In an embodiment, the partner microphone unit comprises a voice activity detector for estimating whether or not or with which probability a voice of the person is present in the current sound from the environment and is configured to provide a voice activity control signal indicative thereof, or is configured to receive such voice activity control signal from another device (e.g. from the 'another device', e.g. the hearing device (e.g. a hearing aid), or from a telephone).

In general, voice activity detection may be implemented in any appropriate way known in the art. In an embodiment, the hearing system is arranged to provide that at least two of the input units comprise a level detector for detecting an input level of the sound picked up by the microphones of the input units in question, and wherein the voice activity detector is configured to base the voice activity control signal on the difference between the input levels of the respective electric input signals of the microphones. In an embodiment, where the partner microphone unit is oriented as intended relative to the target sound, the input level determined by a given input unit will be higher the closer to the target source is to the microphone of the input units. Based thereon, it can be estimated whether the target sound (the person's voice) is currently present or not (e.g. if such level difference is above (present) or below (absent) a predefined threshold value). In an embodiment, where the partner microphone comprises a microphone array with three of more microphones (not arranged on a straight line), the partner microphone unit is configured to use the individual levels detected by the individual microphones when the target sound is active, to determine an orientation of the partner microphone unit relative to the target sound source. Thereby an estimate of the current look vector may be determined.

In an embodiment, the partner microphone is adapted to be worn by a person. In an embodiment, the partner microphone unit comprises a configurable neck strap for wearing the partner microphone around the neck (e.g. on the chest) of the person, and for adjusting the distance between the mouth of the person and the location of the microphone units of the partner microphone. In an embodiment, the partner microphone unit comprises a clip or similar functional unit for attaching the partner microphone unit to a piece of cloth of the person, e.g. a shirt or jacket or a tie. In an embodiment, the partner microphone comprises a configurable support member, allowing the partner microphone to be positioned on a support surface so that the input units have a configurable position (and/or direction) relative to the target sound source (e.g. the person's mouth). In an embodiment, the partner microphone unit is configured to have a preferred direction defined by the physical arrangement of the multitude of input units so that—when the partner microphone unit is arranged on the person with its preferred direction pointing towards the target sound source (typically the person's mouth) at least one of the microphones of the input units is closer to the target sound source than any of the other microphones.

In an embodiment, the multi-input unit noise reduction system is configured to estimate a noise power spectral density of disturbing background noise when the voice of the person is not present. Preferably, the estimate of noise power spectral density is used to more efficiently reduce noise components in (and thereby improve) the estimate of the target signal. In an embodiment, the multi-input unit noise reduction system is configured to update inter-microphone noise covariance matrices when the person's voice is not present (i.e. when the person is silent). Thereby the shape of the beam pattern is adapted to provide maximum spatial noise reduction.

In an embodiment, the partner microphone unit comprises a memory comprising a predefined reference look vector defining a reference spatial direction from the partner microphone unit to the target sound source. In an embodiment, the predefined look vector is defined in an off-line procedure before use of the partner microphone. Default beamformer weights (corresponding to the reference look vector) are e.g. determined in an offline calibration process conducted in a sound studio with a head-and-torso-simulator (HATS, Head and Torso Simulator 4128C from Brüel & Kjær Sound & Vibration Measurement A/S) with play-back of voice signals from the dummy head's mouth, and a partner microphone unit mounted in a default position on the "chest" of the dummy head. In an embodiment, the default beamformer weights are stored in the memory, e.g. together with the reference look vector. In this way, e.g., optimal minimum-variance distortion-less response (MVDR) beamformer weights may be found, which are hardwired, i.e. stored in memory, in the partner microphone unit.

In an embodiment, the multi-channel variable beamformer filtering unit comprises an MVDR filter providing filter weights $w_{mvdr}(k,m)$, said filter weights $w_{mvdr}(k,m)$ being based on a look vector d(k,m) and an inter-input unit covariance matrix $R_{vv}(k,m)$ for the noise signal.

In an embodiment, the multi-input unit noise reduction system is configured to adaptively estimate a current look vector d(k,m) of the beamformer filtering unit for a target signal originating from a target signal source located at a specific location relative to the person wearing the partner microphone unit. In a preferred embodiment, the specific location relative to the person is the location of the person's mouth.

The look vector d(k,m) is an M-dimensional vector comprising elements (i=1, 2, . . . , M), the $i^{th}$ element $d_i(k,m)$ defining an acoustic transfer function from the target signal source (at a given location relative to the input units of the partner microphone unit) to the $i^{th}$ input unit (e.g. a microphone), or the relative acoustic transfer function from the $i^{th}$ input unit to a reference input unit. The vector element $d_i(k,m)$ is typically a complex number for a specific frequency (k) and time unit (m). The look vector d(k,m) may be estimated from the inter microphone covariance matrix $\hat{R}_{ss}(k,m)$ based on signals $s_i(k,m)$, i=1, 2, . . . , M from a signal source measured at the respective microphones when the target signal source is located at the given location (e.g. the person's mouth).

In an embodiment, the multi-input unit noise reduction system is configured to update the look vector when the target sound is present or present with a probability larger than a predefined value (e.g. 60%). The spatial direction of the beamformer, e.g. technically, represented by the so-called look-vector, is preferably updated when the target sound (the person's voice) is present. This adaptation is intended to compensate for a variation in the position of the microphone unit (across time and from person to person) and for differences in physical characteristics (e.g., head and shoulder characteristics) of the user of the partner microphone unit. Preferably, the look vector is only updated, when the target sound is present and when the level of the noise components of the environment sound is relatively low, e.g. below a predefined absolute or relative level (i.e. when the target signal to noise ratio is above a certain threshold value). Preferably the partner microphone unit comprises a noise level estimator or a signal to noise ratio estimator or is configured to receive such information form another device, when needed, e.g. on demand, e.g. before a currently determined look vector is accepted and used in the beamformer (and stored in the memory).

In an embodiment, the partner microphone unit is configured to limit the update of the look vector by comparing currently determined beamformer weights corresponding to a current look vector with the default weights corresponding to the reference look vector, and to constrain or neglect the currently determined beamformer weights if these differ from the default weights more than a predefined absolute or relative amount.

In an embodiment, the partner microphone unit comprising a memory comprises predefined inter-microphone noise covariance matrices of the partner microphone unit. Preferably, the partner microphone unit is located as intended relative to a target sound source and a typical (expected) noise source/distribution is applied, e.g. an isotropically distributed (diffuse) noise. In an embodiment, predefined inter-microphone noise covariance matrices are determined in an off-line procedure before use of the partner microphone unit, preferably conducted in a sound studio with a head-and-torso-simulator (HATS, Head and Torso Simulator 4128C from Brüel & Kjær Sound & Vibration Measurement A/S).

In an embodiment, the partner microphone unit is configured to control the update of the noise power spectral density of disturbing background noise by comparing currently determined inter-microphone noise covariance matrices with the reference inter-microphone noise covariance matrices, and to constrain or neglect the update of the noise power spectral density of disturbing background noise if the currently determined inter-microphone noise covariance matrices differ from the reference inter-microphone noise covariance matrices by more than a predefined absolute or relative amount. Thereby the adaptation of the beamformer is restrained from 'running away' in an uncontrolled manner.

In an embodiment, the multi-channel noise reduction system comprises a single channel noise reduction unit operationally coupled to the beamformer filtering unit and configured for reducing residual noise in the beamformed signal and providing the estimate $\hat{S}$ of the target signal s. An aim of the single channel post filtering process is to suppress noise components from the target direction (which has not been suppressed by the spatial filtering process (e.g. an MVDR beamforming process). It is a further aim to suppress noise components during which the target signal is present or dominant as well as when the target signal is absent. In an embodiment, the single channel post filtering process is based on an estimate of a target signal to noise ratio for each time-frequency tile (m,k). In an embodiment, the estimate of the target signal to noise ratio for each time-frequency tile (m,k) is determined from the beamformed signal and a target-cancelled signal.

In an embodiment, the hearing device and/or the partner microphone unit comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device (e.g. a telephone) or another hearing device. In an embodiment, the direct electric input signal represents or comprises an audio signal and/or a control signal and/or an information signal. In an embodiment, the hearing device and/or the partner microphone unit comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is used under power constraints. In an embodiment, the wireless link is a link based on near-field communication, e.g. an inductive link based on an inductive coupling between antenna coils of transmitter and receiver parts. In another embodiment, the wireless link is based on far-field, electromagnetic radiation.

Preferably, frequencies used to establish a communication link between the hearing device and the partner microphone unit and/or other devices is below 70 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device and the partner microphone unit are portable device, e.g. devices comprising a local energy source, e.g. a battery, e.g. a rechargeable battery.

In an embodiment, the hearing device and/or the partner microphone unit comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing device(s) and/or the partner microphone unit comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device and/or the partner microphone unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{Min}$ to a maximum frequency $f_{Max}$ comprises a part of the typical human audible frequency range from 20 Hz to 20 kHz, e.g. a part of the range from 20 Hz to 12 kHz.

In an embodiment, the hearing device and/or the partner microphone unit comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device and/or the partner microphone unit comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device and/or the partner microphone unit comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device and/or the partner microphone unit further comprises other relevant functionality for the application in question, e.g. compression, feedback reduction, etc.

Use:

In an aspect, use of a partner microphone unit as described above, in the 'detailed description of embodiments' and in the claims, is moreover provided. In an embodiment, use of a partner microphone unit in a hearing aid system to pick up and reduce noise in a voice of a speaker or communication partner and to transmit the noise reduced signal to a hearing device worn by a user is furthermore provided.

A Hearing System:

In a further aspect, a hearing system comprising a partner microphone unit as described above, in the detailed description below and in the claims and a hearing device is furthermore provided. The hearing device comprises antenna and transceiver circuitry for establishing a communication link to and receiving an audio signal comprising an estimate of the target sound s comprising a voice of a person from the partner microphone unit.

In an embodiment, the hearing device comprises an input transducer for picking up sound from the environment of the hearing device and providing an electric hearing device input signal, a signal processing unit for applying one or more processing algorithms to the electric hearing device input signal and providing a processed hearing device signal, and an output unit for providing stimuli perceived by a user as sound based on the processed hearing device signal or a signal originating therefrom, and an analysis unit configured to analyse the audio signal received from the partner microphone unit, and to generate one or more control signals for controlling said one or more processing algorithms. In an embodiment, the one or more processing algorithms comprises a transient reduction algorithm and a compression and amplification algorithm. The signal path from the input unit to the output unit defines a forward path of the hearing device.

In an embodiment, a forward path is defined in the hearing device from an input transducer to an output unit and wherein the forward path comprises a selection of mixing unit allowing the audio signal received from the partner microphone unit to be added to or combined with a signal of the forward path or to be switched into the forward path instead of a signal picked up by the input transducer.

In an embodiment, the hearing device comprises a delay unit configured to delay the audio signal received from the partner microphone unit with a predefined or dynamically determined delay time.

In an embodiment, the hearing device comprises a control unit for receiving said estimate $\hat{S}$ of the target sound s comprising the person's voice from the partner microphone and configured to dynamically control transient reduction or maximum gain of the electric hearing device input signal or a signal originating therefrom.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input transducer for converting an input sound to an electric input signal. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing system comprises a multitude of partner microphones as described above, in the detailed description below and in the claims. In an embodiment, the hearing system comprises two partner microphones.

In an embodiment, the hearing system comprises four or more partner microphones.

In an embodiment, the hearing system further comprises an auxiliary device.

In an embodiment, the hearing system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the auxiliary device is or comprises a cellular telephone, e.g. a SmartPhone. In an embodiment, the function of a remote control is implemented in a SmartPhone, the SmartPhone possibly running an APP allowing to control the functionality of the audio processing device via the SmartPhone. Preferably, the hearing device(s), and the partner microphone(s) comprises an appropriate wireless interface to the auxiliary device (e.g. a SmartPhone), e.g. based on Bluetooth or some other standardized or proprietary scheme).

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising one or two hearing devices and being adapted to cooperatively provide audible signals to both of the user's ears. Hearing systems or binaural hearing systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
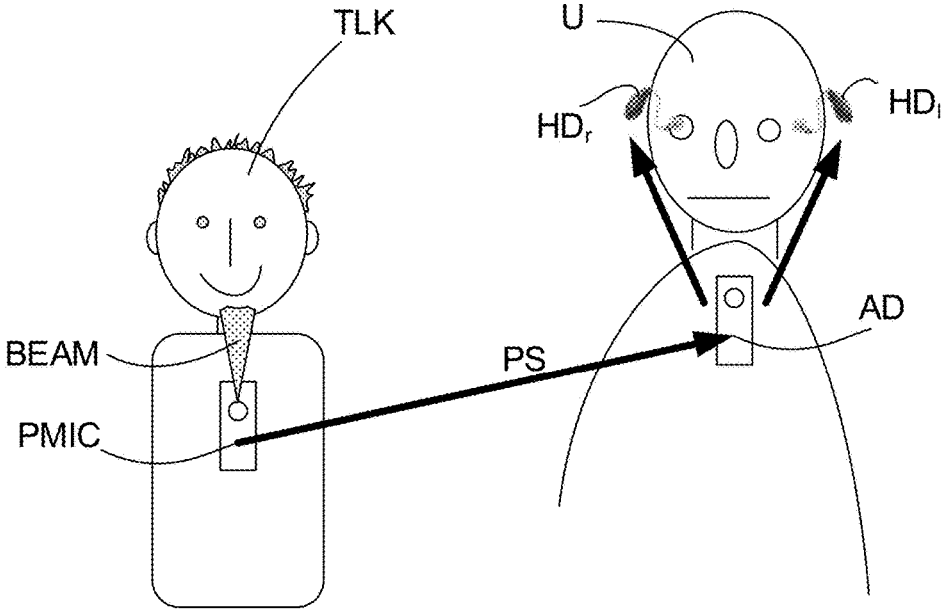
FIG. 1A shows a first exemplary use scenario of a hearing system according to the present disclosure comprising a partner microphone unit and a pair of hearing devices.
Figure 1B:
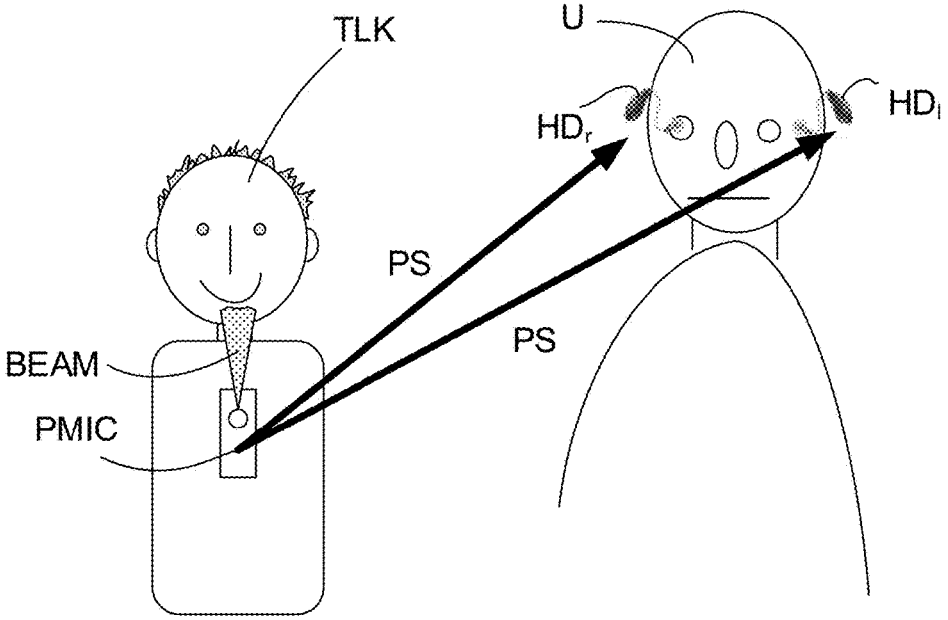
FIG. 1B shows a second exemplary use scenario of a hearing system according to the present disclosure comprising a partner microphone unit and a pair of hearing devices.

FIGS. 1A and 1B shows two exemplary use scenarios of a hearing system according to the present disclosure comprising a partner microphone unit (PMIC) and a pair of (left and right) hearing devices ($HD_l$, $HD_r$). The left and right hearing devices (e.g. forming part of a binaural hearing aid system) are worn by a user (U) at left and right ears, respectively. The partner microphone is worn by a communication partner or a speaker (TLK), whom the user wishes to engage in discussion with and/or listen to. The partner microphone (PMIC) may be a unit worn by a person (TLK) that at a given time only intends to communicate with the user (U). In a particular scenario, the partner microphone (PMIC) may form part of a larger system (e.g. a public address system), where the speaker's voice is transmitted to the user and possible other users of hearing devices, and possibly acoustically broadcast via loudspeakers as well. The partner microphone according to the present disclosure may be used in either situation. The multi-input microphone system of the partner microphone is configured to focus on the target sound source (the voice of the wearer) and hence direct its sensitivity towards its wearer's mouth, cf. (ideally) cone-formed beam (BEAM) from the partner microphone unit to the mouth of the speaker (TLK). The target signal thus picked up is transmitted to the left and right hearing devices ($HD_l$, $HD_r$) worn by the user (U). FIG. 1A and FIG. 1B illustrate two possible scenarios of the transmission path from the partner microphone unit to the left and right hearing devices ($HD_l$, $HD_r$).

FIG. 1A shows a hearing system comprising a partner microphone (PMIC), a pair of haring devices ($HD_l$, $HD_r$) and (intermediate) auxiliary device (AD). The solid arrows indicate the path of an audio signal (PS) containing the voice of the person (TLK) wearing the partner microphone unit from the partner microphone unit (PMIC) to the auxiliary device (AD) and on to the left and right hearing devices ($HD_l$, $HD_r$). The (intermediate) auxiliary device (AD) may be a mere relay station or may contain various functionality, e.g. provide a translation from one link protocol or technology to another (e.g. from a far-field transmission technology, e.g. based on Bluetooth to a near-field transmission technology (e.g. inductive), e.g. based on NFC or ZigBee or a proprietary protocol. Alternatively the two links may be based on the same transmission technology, e.g. Bluetooth or similar standardized or proprietary scheme.

FIG. 1B shows a hearing system comprising a partner microphone (PMIC), and a pair of haring devices ($HD_l$, $HD_r$). The solid arrows indicate the direct path of an audio signal (PS) containing the voice of the person (TLK) wearing the partner microphone unit (PMIC) from the partner microphone unit to the left and right hearing devices ($HD_l$, $HD_r$). The hearing system is configured to allow an audio link to be established between the partner microphone unit (PMIC) and the left and right hearing devices ($HD_l$, $HD_r$). The partner microphone unit (PMIC) comprises antenna and transceiver circuitry to allow (at least) the transmission of audio signals (PS), and the left and right hearing devices ($HD_l$, $HD_r$) comprises antenna and transceiver circuitry to allow (at least) the reception of audio signals (PS) from the partner microphone unit (PMIC). This link may e.g. be based on far-field communication, e.g. according to a standardized (e.g. Bluetooth or Bluetooth Low Energy) or proprietary scheme.

Figure 2:
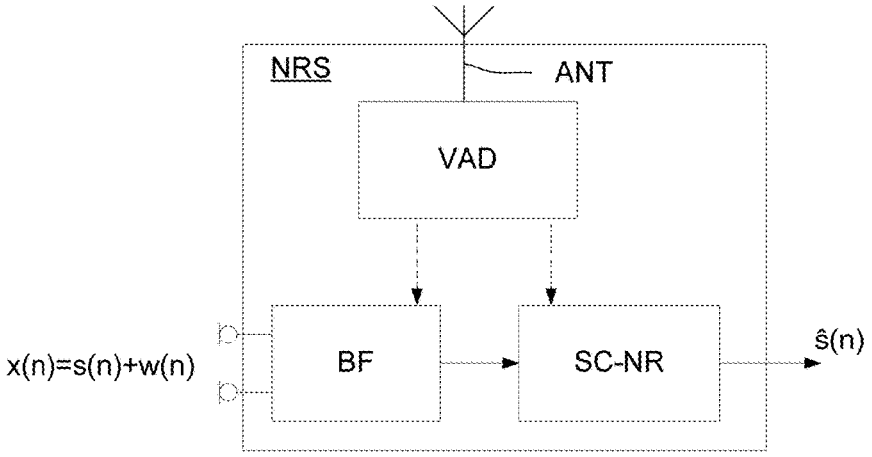
FIG. 2 shows a block diagram of a multi-input beamformer-noise reduction system of a partner microphone unit according to the present disclosure.

FIG. 2 shows a block diagram of a multi-input beamformer-noise reduction system (NRS) of a partner microphone unit (PMIC) according to the present disclosure.

The solution in more detail involves building a dedicated beamformer+single-channel noise reduction (SC-NR) algorithm, similar to the so-called 'MOE system' proposed in [Kjems and Jensen, 2012], which in this situation is able to adapt to the particular problem of retrieving a partner-mic. users voice signal from the noisy microphone signals, and reject/suppress any other sound sources (which can be considered to be noise sources in this particular situation). FIG. 2 shows a conceptual diagram of such a system.

The multi-input noise reduction system may comprise a fixed beameformer with beam directed at an average person's mouth, when the partner microphone is positioned in a predefined position, e.g. on the chest of the person. In a preferred embodiment, an adaptive beamformer—single-channel noise reduction (SC-NR) system is provided in the partner microphone unit.

The beamformer is adaptive in two ways: Firstly, when the partner-microphone wearer is silent, as e.g. detected by a VAD algorithm in the partner-microphone system, or in the hearing device, or another device, cf. optional connection via antenna and transceiver circuitry indicated in FIG. 2 by symbol ANT, e.g. based on voice activity from the far-end speaker, which is easily detected in the microphone unit (or in the hearing device or in the telephone). In such situation, inter-microphone noise covariance matrices may be updated to adapt the shape of the beampattern to allow for maximum spatial noise reduction. Secondly, when the partner-microphone wearer speaks, the beamformers' spatial direction (technically, represented by the so-called look-vector), is updated; this adaptation compensates for variation in partner-microphone position (across time and from wearer to wearer) and for differences in physical characteristics (e.g., head and shoulder characteristics) of the wearer of the partner microphone. Beamformer designs exist which are independent of the exact microphone locations, in the sense that they aim at retrieving the target signal in a minimum mean-square sense or in a minimum-variance distortion less response sense independent of the microphone geometry. In other words, the beamformer "does the best job possible" for any microphone configuration, but some microphone locations are obviously better than other.

Furthermore, the SC-NR system, which may (or may not) be present, is adaptive to the level of the residual noise in the beamformer output; for acoustic situations, where the beamformer already rejected much of the ambient noise, the SNR in the beamformer output is already significantly improved, and the SC-NR system may be essentially transparent. However, in other situations, where a significant amount of residual noise is present in the beamformer output, the SC-NR system may suppress time-frequency regions of the signal, where the SNR is low, to improve the quality of the voice signal to be transmitted to a user of hearing device(s).

The VAD algorithm may use the advantage that the partner microphone is located close to the target talker. If the microphone array is pointing towards the talker's mouth, the sound intensity level will be highest at the microphone closest to the mouth. This level difference may be used to determine when the talker is active.

Before use, default beamformer weights are determined in an offline calibration process conducted in a sound studio with a head-and-torso-simulator (HATS, Head and Torso Simulator 4128C from Brüel & Kjær Sound & Vibration Measurement A/S) with play-back of voice signals from the dummy head's mouth, and a clip mounted in a default position on the "chest" of the dummy head. In this way, e.g., optimal minimum-variance distortion-less response (MVDR) beamformer weights may be found, which are hardwired, i.e. stored in a memory of the partner microphone unit.

The adaptive beamformer—single-channel noise reduction (SC-NR) system allows a departure from the default beamformer weights, to take into account differences between the actual situation (with a real human user in a real (not acoustically ideal) room and a potentially with casual position of the microphone unit relative to the user's mouth) and the default situation (with the dummy in the sound studio and an ideally positioned partner microphone unit).

The adaptation process may be supervised by comparing the adapted beamformer weights with the default weights, and potentially constrain the adapted beamformer weights (or fully dispense with the currently determined beamformer weights) if these differ too much from the default weights.

The noise-reduced voice signal of the partner-mic. wearer is transmitted wirelessly to the hearing aid user, see FIGS. 3 and 4 below.

Figure 3:
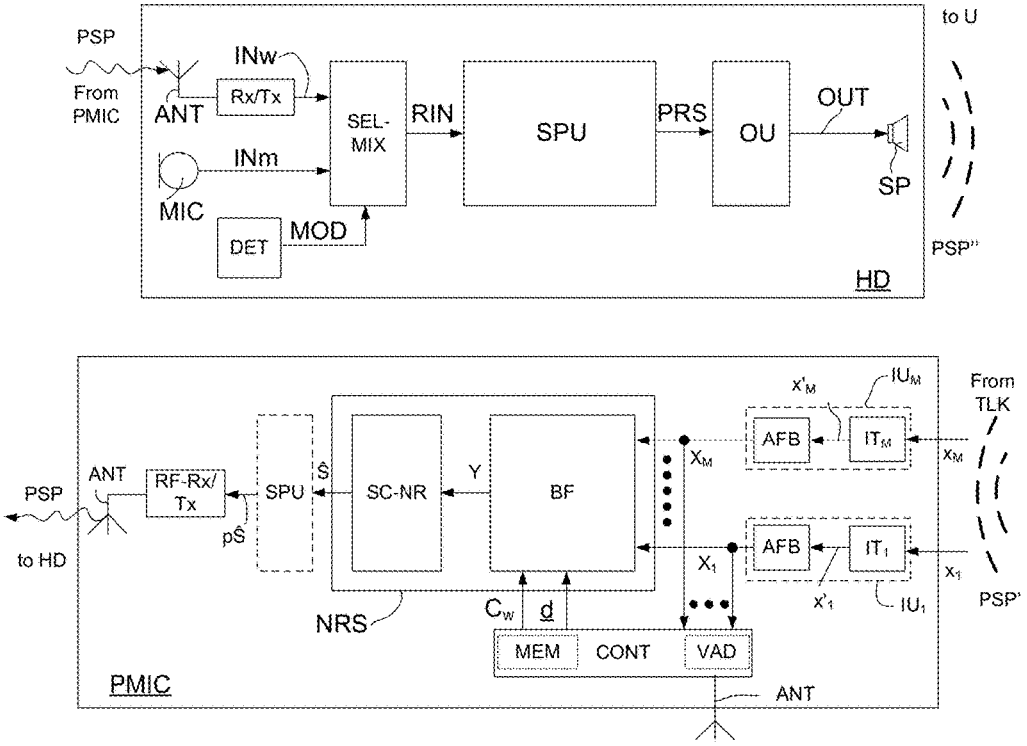
FIG. 3 shows an exemplary block diagram of an embodiment of a hearing system according to the present disclosure comprising a partner microphone unit and a hearing device.

FIG. 3 shows an exemplary block diagram of an embodiment of a hearing system according to the present disclosure comprising a partner microphone unit and a hearing device.

FIG. 3 shows an exemplary block diagram of an embodiment of a hearing system according to the present disclosure comprising a partner microphone unit and a hearing device. FIG. 3 shows a hearing system comprising a hearing device (HD) adapted for being located at or in an ear of a user, or adapted for being fully or partially implanted in the head of the user, and a separate partner microphone unit (PMIC) adapted for being located at a person other than the user of the hearing devices and picking up a voice of the person. The partner microphone unit (PMIC) comprises a multitude M of input units $IU_i$, i=1, 2, . . . , M, each being configured for picking up or receiving a signal $x_i$ (i=1, 2, . . . , M) representative of a sound PSP' from the environment of the partner microphone unit (ideally from the person TLK, cf. reference From TLK in FIG. 3) and configured to provide corresponding electric input signals $X_i$ in a time-frequency representation in a number of frequency bands and a number of time instances. M is larger than or equal to two. In the embodiment of FIG. 3, input units $IU_1$ and $IU_M$ are shown to comprise respective input transducers $IT_1$ and $IT_M$ (e.g. microphones) for converting input sound $x_1$ and $x_M$ to respective (e.g. digitized) electric input signals $x'_1$ and $x'_M$ and each their filterbanks (AFB) for converting electric (time-domain) input signals $x'_1$ and $x'_M$ to respective electric input signals $X_1$ and $X_M$ in a time-frequency representation (k,m). All M input units may be identical to $IU_1$ and $IU_M$ or may be individualized, e.g. to comprise individual normalization or equalization filters and/or wired or wireless transceivers. In an embodiment, one or more of the input units comprises a wired or wireless transceiver configured to receive an audio signal from another device, allowing to provide inputs from input transducers spatially separated from the partner microphone unit. The time-frequency domain input signals ($X_i$, i=1, 2, . . . , M) are fed to a control unit (CONT) and to a multi-input unit noise reduction system (NRS) for providing an estimate $\hat{S}$ of a target signal s comprising the user's voice. The multi-input unit noise reduction system (NRS) comprises a multi-input beamformer filtering unit (BF) operationally coupled to said multitude of input units $IU_i$, i=1, . . . , M, and configured to determine filter weights w(k,m) for providing a beamformed signal Y, wherein signal components from other directions than a direction of a target signal source (the partner person's voice) are attenuated, whereas signal components from the direction of the target signal source are left unattenuated or are attenuated less relative to signal components from other directions. The multi-channel noise reduction system (NRS) of the embodiment of FIG. 3 further comprises a single channel noise reduction unit (SC-NR) operationally coupled to the beamformer filtering unit (BF) and configured for reducing residual noise in the beamformed signal Y and providing the estimate $\hat{S}$ of the target signal (the partner person's voice). The partner microphone unit may further comprise a signal processing unit (SPU) for further processing the estimate $\hat{S}$ of the target signal and provide a further processed signal $p\hat{S}$. The partner microphone unit further comprises antenna and transceiver circuitry ANT, RF-Rx/Tx) for transmitting said estimate $\hat{S}$ (or further processed signal $p\hat{S}$) of the partner microphone user's voice to another device, e.g. a hearing device (her indicated by reference 'to HD, essentially comprising signal PSP, 'partner speech').

The partner microphone unit (PMIC) further comprises a control unit (CONT) configured to provide that the multi-input beamformer filtering unit is adaptive. The control unit (CONT) comprises a memory (MEM) storing reference values of a look vector (d) of the beamformer (and possibly also reference values of the noise-covariance matrices $C_w(k)$). The control unit (CONT) further comprises a voice activity detector (VAD) and/or is adapted to receive information (estimates) about current voice activity of the user of the partner microphone unit. Voice activity information is used to control the timing of the update of the noise reduction system and hence to provide adaptivity.

The hearing device (HD) comprises an input transducer, e.g. microphone (MIC), for converting an input sound to an electric input signal INm. The hearing device may comprise a directional microphone system (e.g. a multi-input beamformer and noise reduction system as discussed in connection with the partner microphone unit, not shown in the embodiment of FIG. 3) adapted to enhance a target acoustic source in the user's environment among a multitude of acoustic sources in the local environment of the user wearing the hearing device (HD), e.g. the partner's voice. However—in a specific partner mode of operation—the hearing device microphone may be disabled or attenuated, so that the signal presented to the user is dominated by the signal comprising the voice of the partner as received from the partner microphone. The hearing device (HD) further comprises an antenna (ANT) and transceiver circuitry (Rx/Tx) for wirelessly receiving a direct electric input signal from another device, e.g. a communication device, or as here from the partner microphone unit, as indicated by reference 'From PM/C' and signal PSP (partner-speech) referring to the scenarios of FIGS. 1A and 1B. The transceiver circuitry comprises appropriate demodulation circuitry for demodulating the received direct electric input to provide the direct electric input signal INw representing an audio signal (and/or a control signal). The hearing device (HD) further comprises a selection and/or mixing unit (SEL-MIX) allowing to select one of the electric input signals (INw, INm) or to provide an appropriate (e.g. weighted) mixture as a resulting input signal RIN. The selection and/or mixing unit (SEL-MIX) is controlled by detection and control unit (DET) via signal MOD determining a mode of operation of the hearing device (in particular controlling the SEL-MIX-unit). The detection and control unit (DET), may e.g. comprise a detector for identifying the mode of operation (e.g. for detecting that the user is engaged in a conversation with or listening to a particular person wearing a partner microphone unit) or is configured to receive such information, e.g. from an external sensor and/or from a user interface.

The hearing device comprises a signal processing unit (SPU) for processing the resulting input signal RIN and is e.g. adapted to provide a frequency dependent gain and/or a level dependent compression and/or a transposition (with or without frequency compression) of one or frequency ranges to one or more other frequency ranges, e.g. to compensate for a hearing impairment of a user. The signal processing unit (SPU) provides a processed signal PRS. The hearing device further comprises an output unit for providing a stimulus OUT configured to be perceived by the user as an acoustic signal based on a processed electric signal PRS. In the embodiment of FIG. 3, the output transducer comprises a loudspeaker (SP) for providing the stimulus OUT as an acoustic signal to the user (here indicated by reference 'to U' and signal PSP' (partner-speech) referring to the scenarios of FIGS. 1A and 1B. The hearing device may alternatively or additionally comprise a number of electrodes of a cochlear implant or a vibrator of a bone conducting hearing device.

The embodiment of FIG. 3 may e.g. exemplify the scenario of FIG. 1B.

Figure 4:
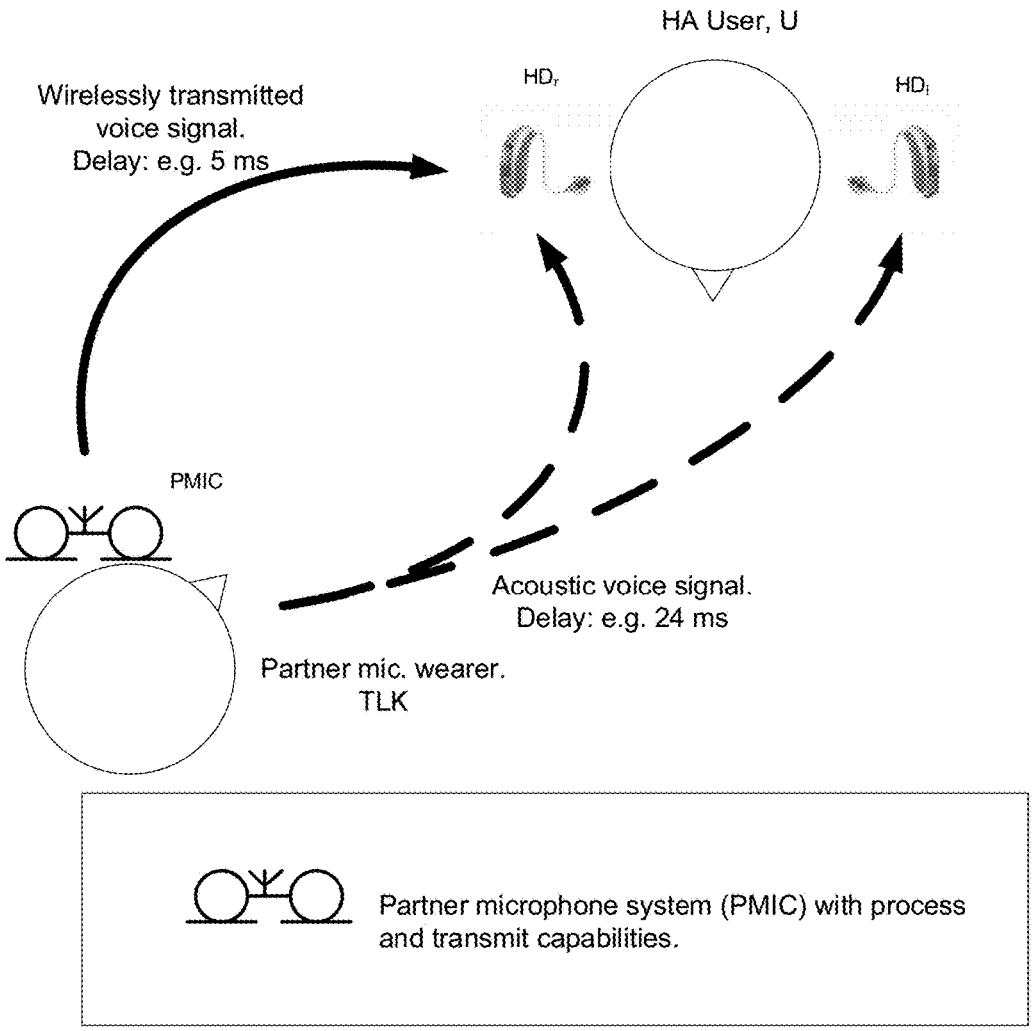
FIG. 4 illustrates a typical situation where an acoustically propagated target signal is received later than a wirelessly transmitted target signal at the hearing aid use.

FIG. 4 shows a typical situation where an acoustically propagated target signal is received later than a wirelessly transmitted target signal at the hearing aid user.

The transmission delay (depending on specific technology choices) can be as low as 3-5 ms. This delay is generally lower than the time it takes for the acoustic voice signal from the partner-microphone wearer to reach the microphones of the hearing aid user (the time for a sound wave to travel a meter is approximately 3 ms). So, for example, if the partner-microphone wearer is at a distance of 8 meters (and we assume a transmission delay of 5 ms), the wireless signal arrives at the hearing aids 8*3−5=19 ms earlier than the acoustic signal. In this situation, the wirelessly received signal is delayed by 19 ms, before it is mixed into the acoustically received signal (see Delay block and Mix block in FIG. 5).

The fact that the wireless signal is generally received at the hearing aid several milliseconds before it needs to be played back to the hearing aid user, offers advantages for the signal processing blocks in the hearing aid, see FIG. 5 below for an exemplary block diagram.

Figure 5:
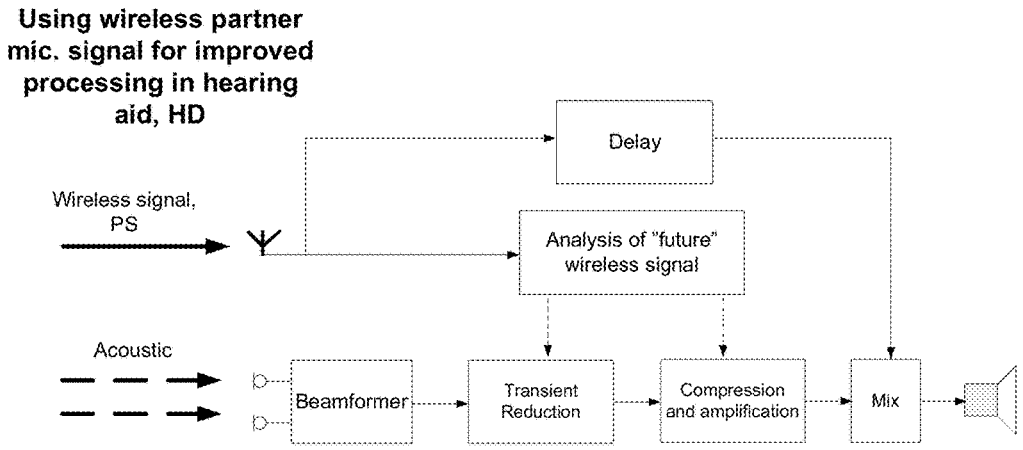
FIG. 5 shows an exemplary block diagram of a hearing device wherein the wirelessly received signal is used for improved transient detection (for transient reduction) and level estimation (for compression and amplification).

FIG. 5 shows an example block diagram of a hearing device receiving a target signal via a wireless link as well as via an acoustic propagation path. The wirelessly received signal is e.g. used for improved transient detection (block Transient Reduction) and level estimation (block Compression and amplification).

For example, knowing part of the future signal (relative to the playback time) allows improved transient reduction (one can actually wait and see if an abrupt increase in signal energy is followed by an abrupt decrease before one has to decide whether a transient is present or not). Furthermore, the hearing-loss compensation (HLC) block in any hearing aid applies a frequency-dependent and time-varying gain to the input sound signal. The HLC gain in a particular frequency-band is a function of the signal power in the frequency-band at the playback time. As for the transient reduction situation, having "future" signal regions available (block Analysis of "future" wireless signal) allows a more accurate estimation of the signal power in a particular frequency region, which in turn allows a more accurate estimate of the HLC gain to be applied.

Having more than one set of partner microphones or several microphones at different locations surrounding the listener will increase the probability of receiving a "future" wireless signal, hereby enabling the possibility of doing "acausal" processing.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Kjems and Jensen; 2012] U. Kjems, J. Jensen, "Maximum likelihood based noise covariance matrix estimation for multi-microphone speech enhancement", 20th European Signal Processing Conference (EUSIPCO 2012), pp. 295-299, 2012.

The invention claimed is:

1. A partner microphone unit configured to pick up target sound from a target sound source, the target sound s comprising a voice of a person, the partner microphone unit comprising:

a multitude of input units $IU_i$, i=1, 2, . . . , M, M being larger than or equal to two, each input unit comprising a microphone for picking up a sound from the environment of the partner microphone unit and configured to provide corresponding electric input signals, each electric input signal comprising a target signal component and a noise signal component;

a multi-input unit noise reduction system for providing an estimate $\hat{S}$ of the target sound s comprising the person's voice, the multi-input unit noise reduction system comprising a multi-input beamformer filtering unit operationally coupled to said multitude of input units $IU_i$, i=1, . . . , M, and configured to determine filter weights for providing a beamformed signal, wherein signal components from other directions than a direction of the target signal source are attenuated, whereas signal components from the direction of the target signal source are left un-attenuated or are attenuated less relative to signal components from said other directions, wherein the multi-input unit noise reduction system is configured to adaptively estimate a current look vector d(k,m) of the beamformer filtering unit for a target signal originating from a target signal source located at a specific location relative to the person wearing the partner microphone unit, wherein the specific location relative to the person is the location of the person's mouth; and antenna and transceiver circuitry for establishing an audio link to another device, wherein the multi-input beamformer filtering unit comprises an adaptive beamformer.

2. A partner microphone unit according to claim 1 wherein the multi-input beamformer filtering unit comprises an MVDR beamformer.

3. A partner microphone unit according to claim 1 comprising a voice activity detector for estimating whether or not or with which probability a voice of the person is present in the current sound from the environment and providing a voice activity control signal indicative thereof, or is configured to receive such voice activity control signal from another device.

4. A partner microphone unit according to claim 3 wherein at least two of the input units comprise a level detector for detecting an input level of the sound picked up by the microphones of the input units in question, and wherein the voice activity detector is configured to base the voice activity control signal on the difference between the input levels of the respective electric input signals of the microphones.

5. A partner microphone unit according to claim 1 adapted to be worn by a person.

6. A partner microphone unit according to claim 1 wherein the multi-input unit noise reduction system is configured to estimate a noise power spectral density of disturbing background noise when the voice of the person is not present, or is present with probability below a predefined level, or to receive such estimate from another device.

7. A partner microphone unit according to claim 1 comprising a memory comprising a predefined reference look vector defining a reference spatial direction from the partner microphone unit to the target sound source.

8. A partner microphone unit according to claim 1 wherein the multi-input unit noise reduction system is configured to update a look vector when the target sound is present or present with a probability larger than a predefined value.

9. A partner microphone unit according to claim 8 configured to limit said update of the look vector by comparing currently determined beamformer weights corresponding to a current look vector with default weights corresponding to the reference look vector, and to constrain or neglect the currently determined beamformer weights if these differ from the default weights more than a predefined absolute ort relative amount.

10. A partner microphone unit according to claim 1 comprising a memory comprising predefined reference inter-microphone noise covariance matrices of the partner microphone unit.

11. A partner microphone unit according to claim 10 configured to control the update of the noise power spectral density of disturbing background noise by comparing currently determined inter-microphone noise covariance matrices with the reference inter-microphone noise covariance matrices, and to constrain or neglect the update of the noise power spectral density of disturbing background noise if the currently determined inter-microphone noise covariance matrices differ from the reference inter-microphone noise covariance matrices by more than a predefined absolute or relative amount.

12. A partner microphone unit according to claim 1 comprising an attachment element for attaching said microphone unit to the user.

13. A partner microphone unit according to claim 1 configured to transmit the estimate $\hat{S}$ of the target sound s comprising the person's voice to the other device, e.g. a hearing device.

14. A hearing system comprising a partner microphone unit according to claim 1 and a hearing device, e.g. a hearing aid, wherein the hearing device comprises antenna and transceiver circuitry for establishing a communication link to and receiving an audio signal comprising an estimate of the target sound s comprising a voice of the person from said partner microphone unit.

15. A hearing system according to claim 14 wherein the hearing device comprises an input transducer for picking up sound from the environment of the hearing device and providing an electric hearing device input signal, a signal processing unit for applying one or more processing algorithms to the electric hearing device input signal, or a signal originating therefrom, and providing a processed hearing device signal, and an output unit for providing stimuli perceived by a user as sound based on the processed hearing device signal or a signal originating therefrom, and an analysis unit configured to analyse the audio signal received from the partner microphone unit, and to generate one or more control signals for controlling said one or more processing algorithms.

16. A hearing system according to claim 14 wherein a forward path is defined in the hearing device from an input transducer to an output unit and wherein the forward path comprises a selection or mixing unit allowing the audio signal received from the partner microphone unit to be combined with a signal of the forward path or to be switched into the forward path instead of a signal picked up by the input transducer.

17. A hearing system according to claim 14 wherein the hearing device comprises a delay unit configured to delay the audio signal received from the partner microphone unit with a predefined or dynamically determined delay time.

18. A hearing system according to claim 14 wherein the hearing device comprises a control unit for receiving said estimate $\hat{S}$ of the target sound s comprising the person's voice from the partner microphone and configured to dynamically control transient reduction or maximum gain of the electric hearing device input signal or a signal originating therefrom.

19. A hearing system according to claim 14 comprising a multitude of partner microphone units.

20. Use of a partner microphone unit as claimed in claim 1 in a hearing aid system to pick up and reduce noise in a voice of a speaker or communication partner and to transmit the noise reduced signal to a hearing device, e.g. a hearing aid, worn by a user.

21. A partner microphone unit according to claim 1 wherein the multi-channel variable beamformer filtering unit comprises an MVDR filter providing filter weights $w_{mvdr}(k,m)$, said filter weights $w_{mvdr}(k,m)$ being based on a look vector d(k,m) and an inter-input unit covariance matrix for the noise signal, wherein the look vector d(k,m) is an M-dimensional vector comprising elements (i=1, 2, . . . , M), the $i^{th}$ element $d_i(k,m)$ defining an acoustic transfer function from the target signal source at a given location relative to the input units of the partner microphone unit to the $i^{th}$ input unit, or the relative acoustic transfer function from the $i^{th}$ input unit to a reference input unit.

22. A hearing system according to claim 14 wherein the hearing device comprises a hearing aid adapted to provide a frequency dependent gain, and/or a level dependent compression, and/or a transposition of one or more frequency ranges to one or more other frequency ranges, to compensate for a hearing impairment of a user.

* * * * *